US006563064B2

(12) United States Patent
Shafique et al.

(10) Patent No.: US 6,563,064 B2
(45) Date of Patent: May 13, 2003

(54) FLUID FLOW SWITCH SENSING DEVICE HAVING A TEST BUTTON

(75) Inventors: Amjed Shafique, Chicago, IL (US); Christopher J. Thomson, Palatine, IL (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/745,251

(22) Filed: Dec. 21, 2000

(65) Prior Publication Data

US 2002/0092745 A1 Jul. 18, 2002

(51) Int. Cl.[7] ..... H01H 35/02
(52) U.S. Cl. ..... 200/81.9 R; 200/81 R; 200/81 H
(58) Field of Search ..... 200/81 R, 81.9 R, 200/81 H, 81.9 M, 84 R, 61.2

(56) References Cited

U.S. PATENT DOCUMENTS 2,237,577 A * 4/1941 Ray ..... 137/66
2,952,753 A * 9/1960 Kmiecik ..... 200/81.9 R
3,126,463 A * 3/1964 Kmiecik ..... 200/81.9 R
3,501,605 A * 3/1970 Hutchinson ..... 200/81 R
3,676,619 A * 7/1972 Hook ..... 200/81 H
3,729,604 A * 4/1973 Groff et al. ..... 200/302.1
4,074,097 A * 2/1978 Hutchinson et al. ..... 200/302.1
4,725,700 A * 2/1988 Zoludow ..... 200/302.1
4,827,092 A 5/1989 Kobold ..... 200/81.9 M
5,144,102 A * 9/1992 Buse ..... 137/554
5,183,983 A 2/1993 Knop ..... 200/81.9 M
5,672,049 A * 9/1997 Ciurlo ..... 200/81.9 R

* cited by examiner

*Primary Examiner*—Michael Friedhofer

(57) ABSTRACT

A fluid flow switch sensing device includes a switch, a pivotally disposed bracket assembly which activates the switch to a desired switch function, and a paddle assembly for causing pivotal movement of the bracket assembly in response to fluid flow in a conduit. A button assembly, cooperatively associated with the bracket assembly, is provided for external manual actuation and deactuation of the fluid flow switch sensing device.

14 Claims, 5 Drawing Sheets

FLUID FLOW SWITCH SENSING DEVICE HAVING A TEST BUTTON

FIELD OF THE INVENTION

This invention is related to a fluid flow switch sensing device and in particular to a fluid flow switch sensing device that can be tested externally for actuation and deactuation after installation thereof in a pipeline, air duct or other conduit.

BACKGROUND OF THE INVENTION

Fluid flow in pipelines, air ducts, and other conduits is an important function in industry and commerce. In many applications, it is essential to be able to determine whether fluid is flowing in a pipeline, duct or other conduit and to respond accordingly to such a determination. As a result, fluid flow switch sensing devices have been developed for monitoring fluid flow in pipelines, ducts, and other conduits.

Many fluid flow switch sensing devices function to create or break an electrical circuit when the flow of fluid in the conduit stops. Hence, such devices can be used for actuating a signal when fluid flow stops, starting a motor with fluid flow, shutting off an alarm when fluid flow is adequate, or stopping a motor with no fluid flow.

Some regulations require fluid flow switch sensing devices to be capable of being tested for actuation and deactuation after installation in pipeline, duct or other conduit where liquids or gases flow. Most existing fluid flow switch sensing devices do this by installing a valve in-line with the flow switch. Therefore, it would be desirable to have a fluid flow switch sensing device, with a testing mechanism internal to the flow switch, which can be tested externally for actuation and deactuation after mounting in a pipeline, duct, or other conduit where fluids flow.

This would provide significant benefits in terms of ease of switch testing operation, simplified piping installation, and lower system piping costs.

SUMMARY OF THE INVENTION

A fluid flow switch sensing device comprising: a switch; a pivotally disposed bracket assembly which activates the switch to a desired switch function; and a paddle assembly for causing pivotal movement of the bracket assembly in response to fluid flow in a conduit. A button assembly, cooperatively associated with the bracket assembly, is provided for external manual actuation and deactuation of the fluid flow switch sensing device.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not to scale.

DETAILED DESCRIPTION OF THE INVENTION

Figure 1:
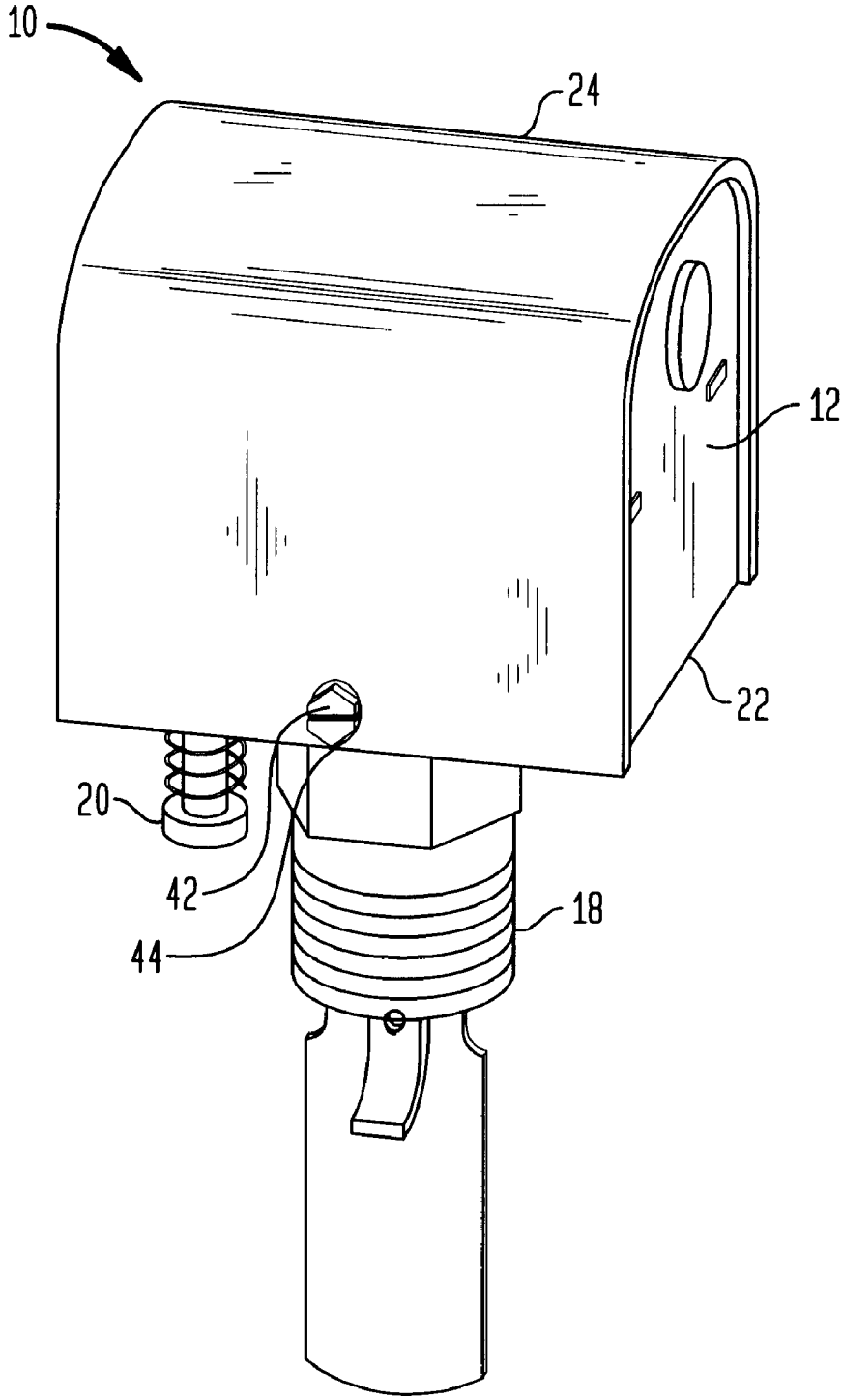
FIG. 1 is a perspective view of a fluid flow switch sensing device made according to an embodiment the present invention.
Figure 2:
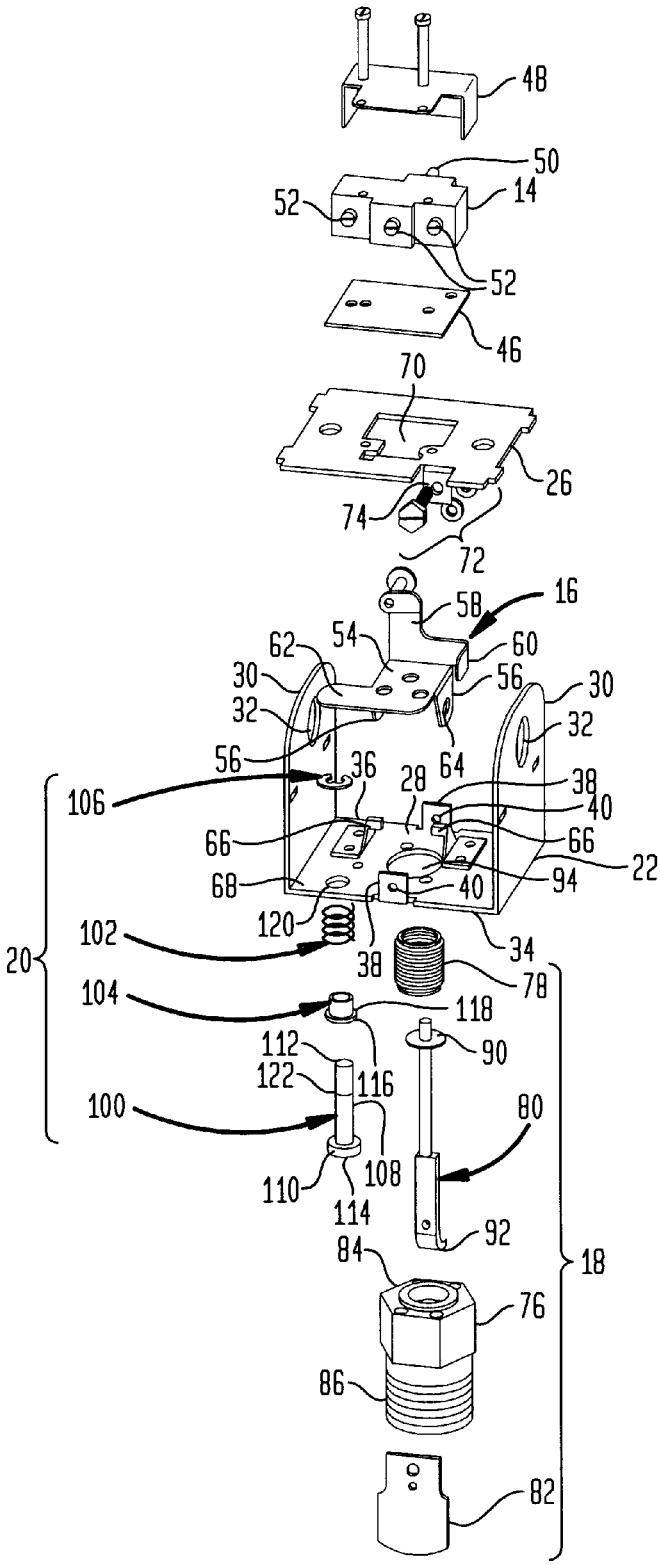
FIG. 2 is an exploded view of the fluid flow switch sensing device of FIG. 1 (absent the cover)
Figure 3:
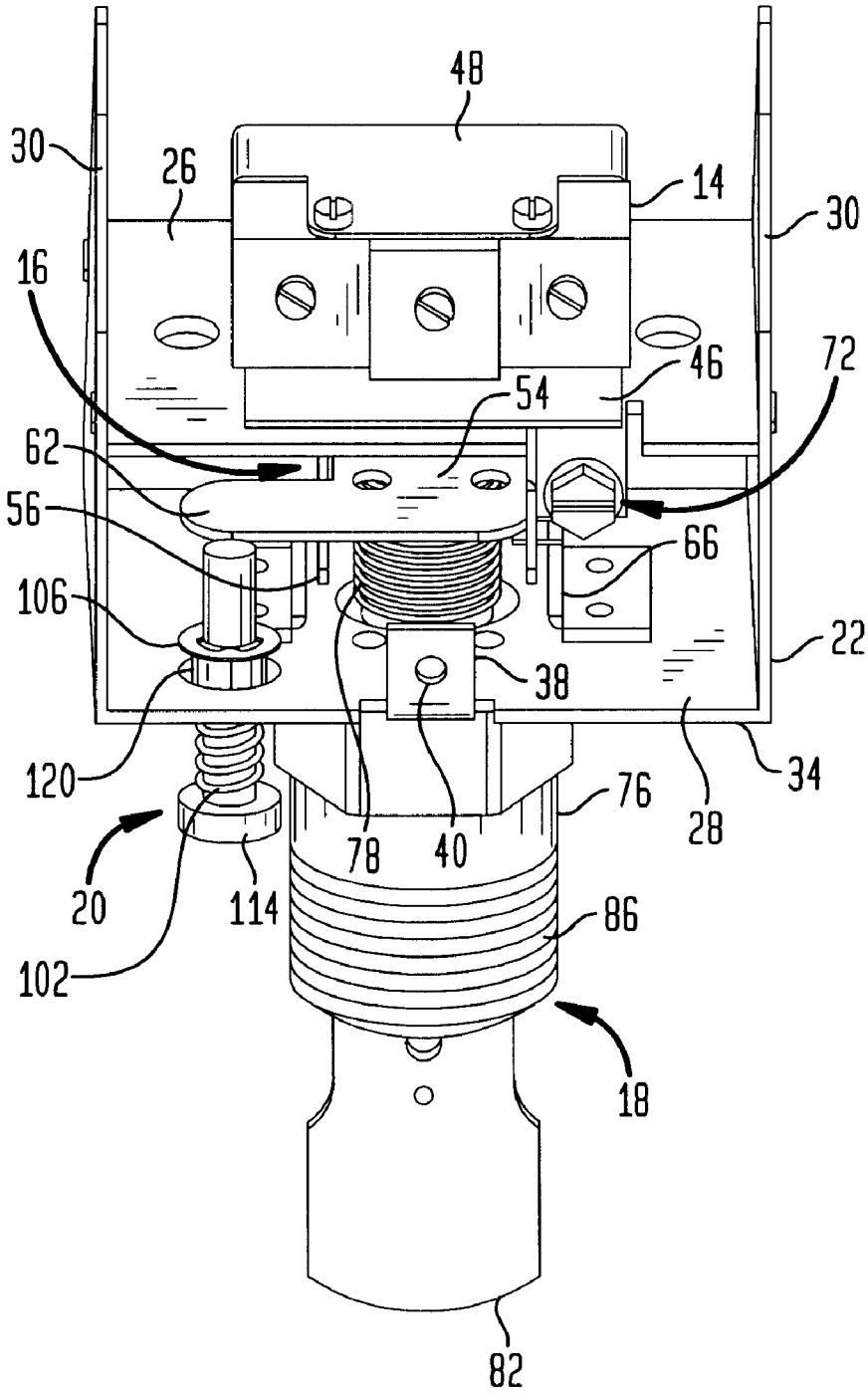
FIG. 3 is a front view of the fluid flow switch sensing device of FIG. 1 with the cover removed.
Figure 4:
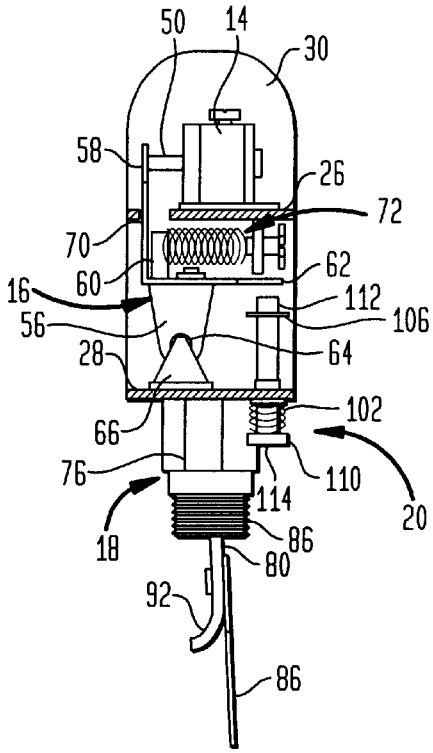
FIG. 4 is a sectional side view of the fluid flow switch sensing device of FIG. 1.

Referring to the drawings wherein like reference numerals identify similar or like elements throughout the several views and initially to FIGS. 1–3, there is collectively shown a fluid flow switch sensing (FFSS) device 10 made according to an embodiment of the present invention. The FFSS device 10 generally comprises an enclosure 12, a switch 14 disposed within the enclosure, a bracket assembly 16 pivotally disposed within the enclosure 12 for activating the switch 14 to a desired switch function, a paddle assembly 18 for causing pivotal movement of the bracket assembly 16 in response to fluid flow in a conduit, and an externally disposed test button assembly 20 that cooperates with the bracket assembly 16 to permit external manual actuation and deactuation of the switch 14.

The enclosure 12 includes a receptacle 22 and an inverted U shaped removable cover 24 both of which are fabricated from any suitable material such as sheet metal. The receptacle 22 includes a switch mounting plate 26 and a bottom wall 28 which both extend between a pair of opposing side walls 30. Each side wall 30 includes a conventional knock-out 32 for receiving the ends of conductor-carrying conduits (not shown). The front and rear edges 34, 36 of the bottom wall 28 include upwardly extending cover fastening tabs 38 which define screw apertures 40 for accommodating screws 42 that extend through slots 44 formed adjacent the bottom edges of the cover 24 and removably retain the cover 24 to receptacle 22.

The switch 14 is mounted on the switch mounting plate 26. A gasket-like member 46 is provided between the switch 14 and the mounting plate 26 for electrically insulating the switch 14 from the enclosure 12. A switch cover 48 is disposed over the switch 14 and insulator member 46. The switch 14 typically comprises an electrical switch such as a single pole double throw electrical switch. However, any other suitable switch design which is capable of operating alarm means including mechanical devices can be used in the present invention. Moreover, the term electrical is used herein to indicate that the switch 14 is operative for controlling an electrical circuit that is associated with powering a motor, pump or the like. In any case, the switch 14 includes a trigger member 50 and a plurality of terminal connections 52. The switch 14 can, therefore, make or break an electrical circuit when appropriately connected if flow starts or stops. Accordingly, the FFSS device 10 can be used for actuating a signal, alarm or other device when flow occurs or when no flow occurs.

The bracket assembly 16 includes a horizontal member 54, a pair of legs 56 projecting down from ends of the horizontal member 54, a switch actuator arm 58 and a setpoint spring engagement arm 60 projecting upwardly from the member 54, and a button engagement extension 62. The button engagement extension 62 can be integral with the horizontal member 54 of the bracket assembly 16 or be a separately attached element. The legs 56 define axially aligned apertures 64 which permit the bracket assembly 16 to be pivotally mounted to the bottom wall 28 of the receptacle 22 by a pair of hook-shaped pivot members 66 affixed to the upper surface 68 of the bottom wall 28. The switch actuator arm 58 projects up through a slot 70 in the mounting plate 26 and pushes against the trigger member 50 of the switch 14 to activate a desired switch function with pivotal movement of the bracket assembly 16. The setpoint spring engagement arm 60 cooperates with a flow/no-flow setpoint compression spring adjuster assembly 72 affixed to a downwardly extending tab 74 of the mounting plate 26. The adjuster 72 operates conventionally to permit the flow/no-flow setpoints of the FFSS device 10 to be increased or decreased. The externally disposed test button assembly 20 cooperatives with the button engagement extension 62 of the bracket assembly 16 to permit external manual actuation and deactuation of the FFSS device 10 as will be explained further on.

Figure 5:
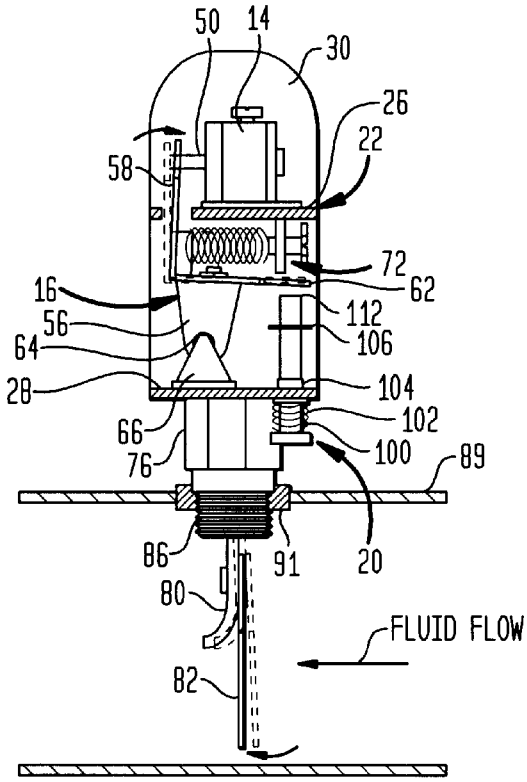
FIGS. 5 and 6 are sectional side views of the fluid flow switch sensing device of FIG. 1 installed to a conduit, respectively showing the general operation of the device (FIG. 5) and the operation of the button assembly (FIG. 6).

The paddle assembly 18 includes a hollow cylindrical body 76, a bellows 78, a paddle arm 80, and a paddle 82. The cylindrical body 78 has a first end 84 affixed to the lower surface of the bottom wall 28 and an externally threaded second end 86 which permits the FFSS device 10 to be threadedly installed to a conduit 89 (through which a fluid whose flow is to be monitored by the FFSS device 10 flows) via an internally threaded fitting or tee connection 91 (FIG. 5). The paddle arm 80 is an elongated member having first and second ends 90, 92. The paddle arm 80 extends through the cylindrical body 76 and a paddle arm aperture 94 in the bottom wall 28 of the receptacle 22. The first end 90 of the paddle arm 80 is connected to the horizontal member 54 of the bracket assembly 16. The portion of the paddle arm 80 extending between the bottom wall 28 of the receptacle 22 and the horizontal member 54 of the bracket assembly 16 is sealingly enclosed by the bellows 78. The bellows 78 is made from metal or any other suitable material and prevents fluid from entering the interior of the enclosure 12 through the paddle arm aperture 94 in the bottom wall 28 of the receptacle 22. The second end 92 of the paddle arm 80 extends out from the second end 86 of the cylindrical body 76. The paddle 82 is coupled to the second end 92 of the paddle arm 80. Thus, when the FFSS device 10 is properly installed in the conduit 89 as shown in FIG. 5, the second end 92 of the paddle arm 80 extends into the conduit 89 such that the paddle 96 is disposed in the line of fluid flow. Fluid flowing at a certain flow rate through the conduit 89 causes the paddle arm 80 to move and actuate the electrical switch 14 of the FFSS device 10 via pivotal movement of the bracket assembly 16.

Referring again to FIGS. 1–3, the test button assembly 20 typically comprises a button 100, a compression spring 102, a bushing 104, and a C-shaped retaining clip 106. The button 100 may be a T-shaped member including an elongated shaft 108 having first and second ends 110, 112, the first end 110 defining an enlarged diameter head member 114. The bushing 104 may also be a T-shape member including a large diameter circular flange 116 and a hollow cylindrical body 118. The bushing 104 may be installed in a press-fit manner in a button aperture 120 formed in the bottom wall 28 of the receptacle 22 with the flange 116 of the bushing 104 abutted against the lower surface of the bottom wall 28. The button 100 is slidingly installed in the bushing 104 with the button head 114 located adjacent the outside of the enclosure 12 and the second end 112 of the button shaft 108 located inside the enclosure 12. The shaft 108 of the button 100 extends through the compression spring 102 and the bushing 104 such that the spring 102 is disposed between the head 114 of the button 100 and the flange 116 of the bushing 104. An annular groove 122 defined about midway on the button shaft 108 receives the retaining clip 106 or any other suitable retaining device that is capable of preventing the withdrawal of the button 100 from the bushing 104. The spring 102 biases the button 100 in a first position which places the second end 112 of the button shaft 108 a distance d from the extension 62 of the bracket assembly 16, thereby enabling the bracket assembly 16 to freely pivot without engaging the button 100.

Figure 6:
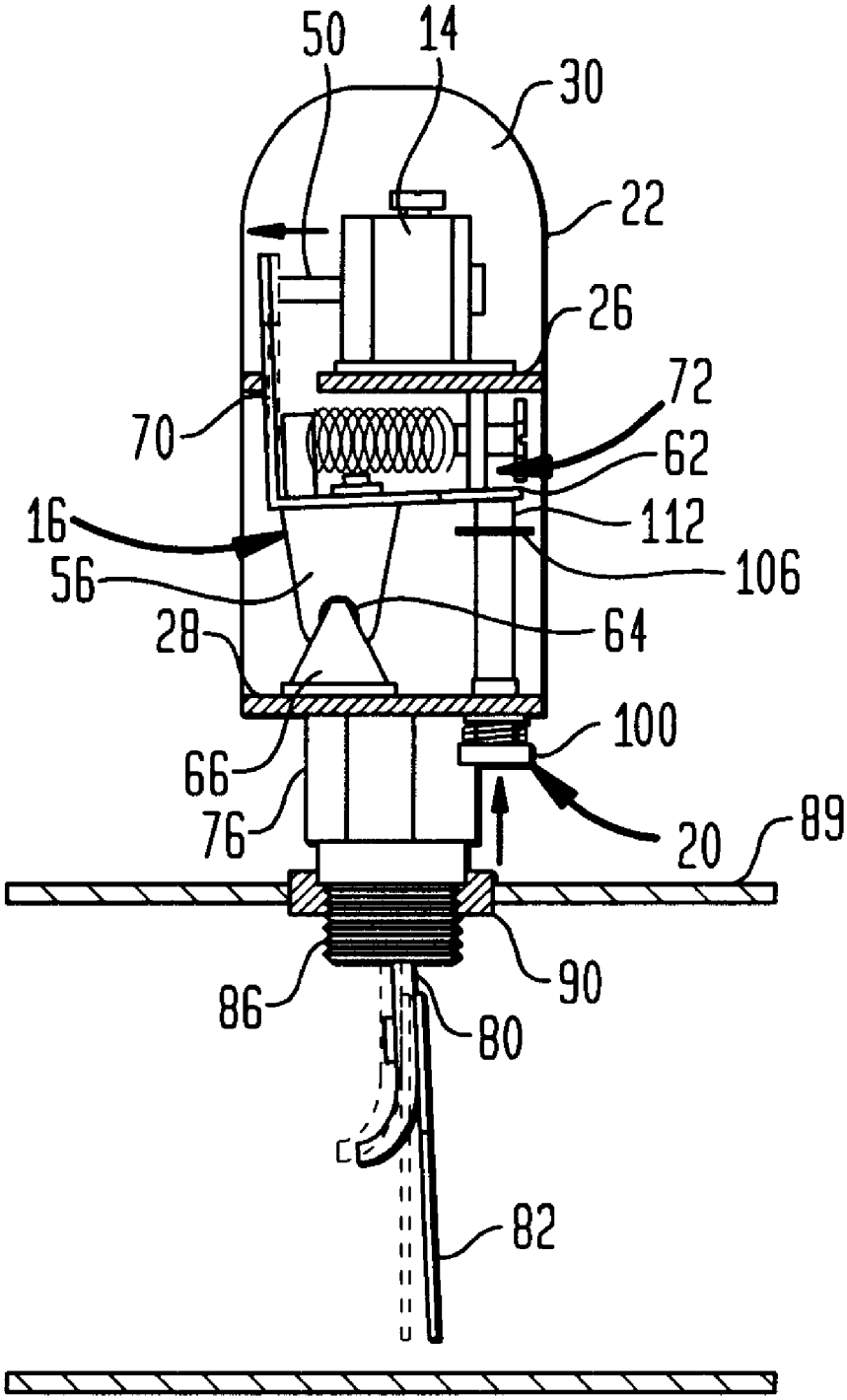

As mentioned earlier, the test button assembly 20 enables the FFSS device 10 to be externally actuated or deactuated. Specifically, as shown in FIG. 6, the FFSS device 10 can be externally deactuated by pushing the button 100 up toward the bushing 104 in a second position, thereby compressing the spring 102. This movement of the button 100 causes the second end 112 thereof to contact the extension 62 of the bracket assembly 16 thereby pivoting the bracket assembly 16, which is in a switch actuation position, in the direction of arrow 126. As the bracket assembly 16 pivots in the direction of arrow 126, the free end of the switch actuator arm 58 moves away from the trigger member 50 of the switch 14 thereby deactuating it. When the button 100 is released, the compression spring 102 returns the button 100 to the first position which allows the bracket assembly 16 to pivot back to the switch actuation position and causes the free end of the switch actuator arm 58 to push against the trigger member 50 thereby actuating the switch 14 again. The bellows 78 of the paddle assembly 18 operates to bias the bracket assembly 16 in the switch actuation position.

The FFSS device 10 of the present invention can be used to make or break an electrical circuit when fluid flow starts or when fluid flow stops, thus, enabling the device to be used for actuating a signal when flow stops; starting a motor with flow; turning off an alarm when flow is adequate; or stopping a motor with no flow. The test button assembly 20 of the FFSS device 10 advantageously permits the device 10 to be tested externally for actuation and deactuation. Accordingly, the FFSS device 10 of the present invention is especially useful in air conditioning, heating, water systems and process work applications.

While the foregoing invention has been described with reference to the above embodiment, various modifications and changes can be made without departing from the spirit of the invention. Accordingly, such modifications and changes are considered to be within the scope of the appended claims.

What is claimed is:

1. A fluid flow switch sensing device comprising:

an enclosure;

a switch disposed within the enclosure;

a bracket pivotally mounted to a wall of the enclosure, wherein pivotal movement of the bracket activates the switch to a desired switch function, the bracket including a button extension;

a paddle arm coupled to the bracket for causing pivotal movement of the bracket in response to fluid flow in a conduit;

a button extending through the enclosure and cooperatively associated with the bracket for external manual actuation and deactuation of the fluid flow switch sensing device, the button including an end which engages the button extension when the button is pressed; and a hollow body affixed to a lower surface of the enclosure, the body enabling the device to be threadedly installed to the conduit through which a fluid flows, the flow of the fluid being monitored by the device;

wherein a space is maintained between the end of the button and the button engagement extension when the button is in a rest position.

2. The fluid flow switch sensing device according to claim 1, wherein the bracket includes an adjuster which enables flow and no-flow setpoints of the device to be selectively adjusted.

3. The fluid flow switch sensing device according to claim 1, wherein the button has a head member which is disposed external to the enclosure.

4. The fluid flow switch sensing device according to claim 1, further comprising a spring for biasing the button in a first direction to maintain the space between the end of the button and the button engagement extension when the button is in a rest position.

5. The fluid flow switch sensing device according to claim 1, wherein the paddle arm extends through the hollow body.

6. The fluid flow switch sensing device according to claim 1, further comprising a paddle coupled to one end of the paddle arm, the paddle being disposed in a line of fluid flow when the device is installed to the conduit.

7. A fluid flow switch sensing device comprising:

a switch;

an enclosure for housing the switch;

a bracket assembly including a horizontal member, a button extension extending from the horizontal member, and at least one leg projecting down from the horizontal member, the at least one leg pivotally mounted to a wall of the enclosure, wherein pivotal movement of the bracket assembly activates the switch to a desired switch function;

a paddle assembly for causing pivotal movement of the bracket assembly in response to fluid flow in a conduit; and a button assembly cooperatively associated with the bracket assembly for external manual actuation and deactuation of the fluid flow switch sensing device, the button assembly including a button having an end which engages the button extension when the button is pressed;

wherein a space is maintained between the end of the button and the button engagement extension when the button is in a rest position.

8. The fluid flow switch sensing device according to claim 7, wherein the bracket assembly includes an adjuster which enables flow and no-flow setpoints of the device to be selectively adjusted.

9. The fluid flow switch sensing device according to claim 7, wherein the button assembly includes a button a portion of which is disposed external to the enclosure.

10. The fluid flow switch sensing device according to claim 7, wherein the button assembly includes a button and a spring for biasing the button in a first direction to maintain the space between the end of the button and the button engagement extension when the button is in a rest position.

11. The fluid flow switch sensing device according to claim 7, wherein the paddle assembly includes a hollow body affixed to a lower surface of the enclosure, the body enabling the device to be threadedly installed to the conduit through which a fluid flows, the flow of the fluid being monitored by the device.

12. The fluid flow switch sensing device according to claim 11, wherein the paddle assembly further includes a paddle arm that extends through the hollow body and is coupled to the bracket assembly, the paddle arm causing the pivotal movement of the bracket assembly in response to fluid flow in the conduit.

13. The fluid flow switch sensing device according to claim 7, wherein the paddle assembly includes a paddle arm and a paddle, the paddle arm coupled to the bracket assembly and causing the pivotal movement of the bracket assembly in response to fluid flow in the conduit, the paddle coupled to one end of the paddle arm, the paddle being disposed in a line of fluid flow through the conduit.

14. The fluid flow switch sensing device according to claim 7, the enclosure including a receptacle and a cover.

* * * * *